US006286919B1

(12) United States Patent
Fleisch

(10) Patent No.: US 6,286,919 B1
(45) Date of Patent: Sep. 11, 2001

(54) DEVICE FOR FIXING THE FRONT PANEL OF A DRAWER

(75) Inventor: Walter Fleisch, Lustenau (AT)

(73) Assignee: Alfit Aktiengesellschaft, Götzis (AT)

( * ) Notice: Subject to any disclaimer, the term of this patent is extended or adjusted under 35 U.S.C. 154(b) by 0 days.

(21) Appl. No.: 09/187,658

(22) Filed: Nov. 6, 1998

(30) Foreign Application Priority Data

Nov. 7, 1997 (AT) ..... 1881/97

(51) Int. Cl.[7] ..... A47B 88/00

(52) U.S. Cl. ..... 312/348.4; 312/348.2; 312/348.1; 403/231

(58) Field of Search ..... 312/348.4, 348.1, 312/348.2; 403/231

(56) References Cited

U.S. PATENT DOCUMENTS 4,802,716 * 2/1989 Rock et al. .
4,815,796 * 3/1989 Rock et al. .
5,688,033 * 11/1997 Fleisch et al. .
6,027,194 * 2/2000 Fleisch ..... 312/348.4

FOREIGN PATENT DOCUMENTS 391 253 3/1990 (AT) .
0 761 131 3/1997 (EP) .
2143426 * 2/1985 (GB) .
2190831 * 12/1987 (GB) .

* cited by examiner

*Primary Examiner*—B. Dayoan
*Assistant Examiner*—Tomlyne Malcolm
(74) *Attorney, Agent, or Firm*—Collard & Roe, P.C.

(57) ABSTRACT

There is described a device for fixing the front panel (1) of a drawer on a lateral, metallic frame (2) of the drawer by means of a holder (3) provided on the front panel (1) and protruding against the frame (2), which holder consists of a supporting plate (4) and a pressing plate (5), between which the frame (2) can be clamped by means of a clamping screw (6) extending through the frame (2) in an insertion slot (12) open at the front, where the holder (3) on the one hand has an adjusting eccentric (18) vertically supported on a supporting stop (19) of the frame (2) and on the other hand a locating stop (15), which engages behind a locking stop (14) of the frame (2) extending transverse to the longitudinal direction of the frame and having an inclined stop face (17). To create advantageous constructional conditions it is proposed that the adjusting eccentric (18) engages in the insertion slot (12) extending in longitudinal direction of the frame, and that the forwardly directed edge of a widened portion (13) of the insertion slot (12), which extends transverse to the longitudinal direction of the frame, constitutes the locking stop (14).

6 Claims, 2 Drawing Sheets

DEVICE FOR FIXING THE FRONT PANEL OF A DRAWER

1. Field of the Invention

This invention relates to a device for fixing the front panel of a drawer on a lateral, metallic frame of the drawer by means of a holder provided at the front panel and protruding towards the frame, which holder consists of a supporting plate and a clamping plate, between which the frame can be clamped by means of a clamping screw extending through the frame in an insertion slot open at an end facing the front panel. The holder has an adjusting eccentric vertically supported on a supporting stop of the frame, and a locating stop, which engages behind a locking stop of the frame, which has an inclined stop face and extends transverse to the longitudinal direction of the frame.

2. Description of the Prior Art

For fixing the front panel of a drawer on a metallic frame of the drawer it is known from FIGS. 11 to 16 of U.S. Pat. No. 4,815,796 to fix at the front panel a holder protruding towards the frame, which holder consists of a supporting plate and a clamping plate, between which and the supporting plate the frame can be clamped. For this purpose, the supporting plate has a threaded hole for a clamping screw which extends through the clamping plate. Since the frame is provided with an insertion slot open at an end facing the front panel and extending like a hook the holder of the front panel can be hung into the insertion slot of the frame, with the frame extending between the supporting and clamping plates. With an edge extending transverse to the longitudinal direction of the frame and bent towards the frame under an obtuse angle the clamping plate forms a locating stop, which engages over a locking stop formed on the frame and protruding towards the clamping plate, so that upon tightening the clamping screw the clamping plate is pulled against the locking stop in longitudinal direction of the frame due to the stop face formed by the bent edge, with the effect that the holder rests against the front end face of the frame without any clearance. For the vertical adjustment of the front panel the clamping plate of the holder is provided with an adjusting eccentric, which is vertically supported on a supporting stop formed by a bent-out lug of the frame. When the desired vertical position of the front panel with respect to the frame has been fixed by means of the adjusting eccentric, the frame can be clamped between the supporting plate and the clamping plate by tightening the clamping screw.

SUMMARY OF THE INVENTION

It is therefore the object of the invention to provide a device as described above for fixing the front panel of a drawer with a simple structure such that cutting out and bending out lugs in the frame for forming the supporting and locking stops becomes superfluous.

This object is solved by the invention in that the adjusting eccentric engages in the insertion slot extending in longitudinal direction of the frame, and that the forwardly directed edge of a widened portion of the insertion slot, which extends transverse to the longitudinal direction of the frame, forms the locking stop.

Since as a result of these measures the adjusting eccentric is supported at the lower edge of the insertion slot for the clamping screw, and the locking stop of the holder engages in the widened portion of the insertion slot extending transverse to the longitudinal direction of the frame, no additional structures are required to support the supporting stop and the locking stop. Supporting the adjusting eccentric and the locating stop at the edge of the insertion slot or its widened portion not only involves a simplification of the construction of the frame, but also provides for a small overall depth, because supporting the adjusting eccentric or the locating stop need not be effected laterally protruding from the side face of the frame.

Particularly stable constructional conditions are obtained in an embodiment of the invention if the supporting plate consists of a bent portion of a mounting flange for the front panel, into which the pressing plate constituting the locating stop can be hooked. By hooking the clamping plate into the mounting flange integrally connected with the supporting plate, the pressing plate is additionally supported with respect to the supporting plate, so that upon tightening the clamping screw the clamping plate is swivelled against the frame about the additional bearing point on the mounting flange formed by such hanging, until a stable positive connection between the holder and the frame is obtained by means of the locating stop supported in the widened portion of the insertion slot. This connection has a much higher load-bearing capacity than a connection where the clamping plate is supported on the supporting plate merely by the clamping screw.

When the clamping plate hung into the mounting flange is swivelled against the supporting plate under a bias, this bias effects a detachment of the clamping plate from the frame when the clamping screw is loosened, which considerably facilitates the withdrawal of the holder of the front panel from the frame or the mounting of the holder on the frame. Another possibility for swivelling out the clamping plate when loosened the clamping screw is obtained if the clamping screw has an engaging stop for the clamping plate hung into the mounting flange on the side of the clamping plate facing away from the clamping screw head, so that this engaging stop pushes the clamping plate away from the supporting plate when the clamping screw is loosened. As an engaging stop a plastic disk may be used, through which the screw shank extends tightly and which is therefore rotated with the screw and not adjusted on the screw shank.

The locating stop of the holder may have different designs, because it is merely decisive to engage behind the locking stop, which has a correspondingly inclined stop face and is formed by the widened portion of the insertion slot in the frame. Particularly simple constructional conditions are obtained, however, when the locating stop consists of a wedge portion protruding towards the supporting plate and formed on the clamping plate, where the wedge face of said wedge portion facing the locking stop is urged against the locking stop upon tightening the clamping screw. The clamping plate can be manufactured comparatively easily together with the suspension hook for the mounting flange, in particular when the supporting plate has the threaded hole for the clamping screw and carries the adjusting eccentric, which in this case can be adjusted via a through hole in the clamping plate.

BRIEF DESCRIPTION OF THE DRAWING

In the drawing, the subject-matter of the invention is represented by way of example, wherein.

DESCRIPTION OF THE PREFERRED EMBODIMENTS

Figure 1:
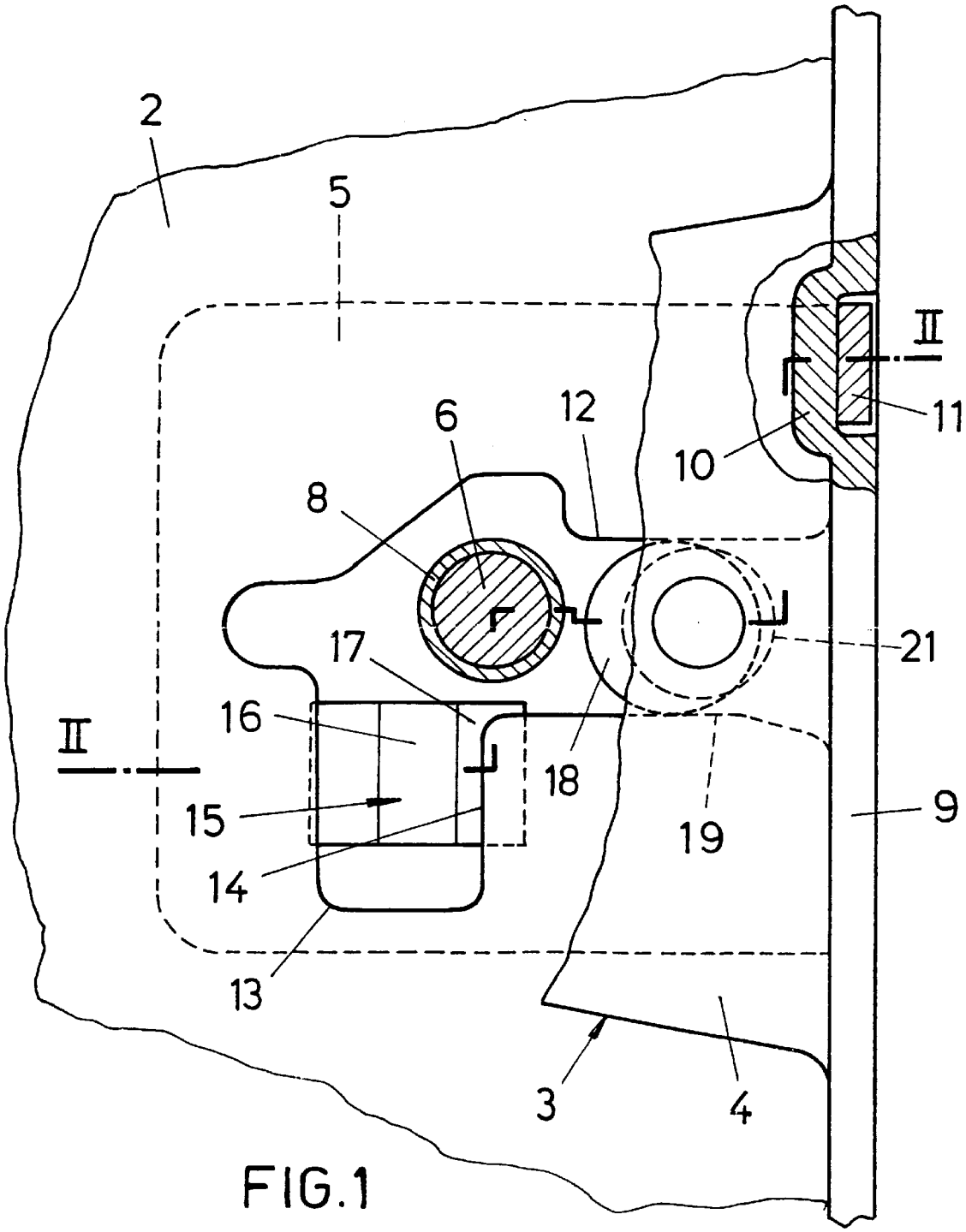
FIG. 1 shows an inventive device for fixing the front panel of a drawer on a metallic frame in a partly cut away side view.
Figure 2:
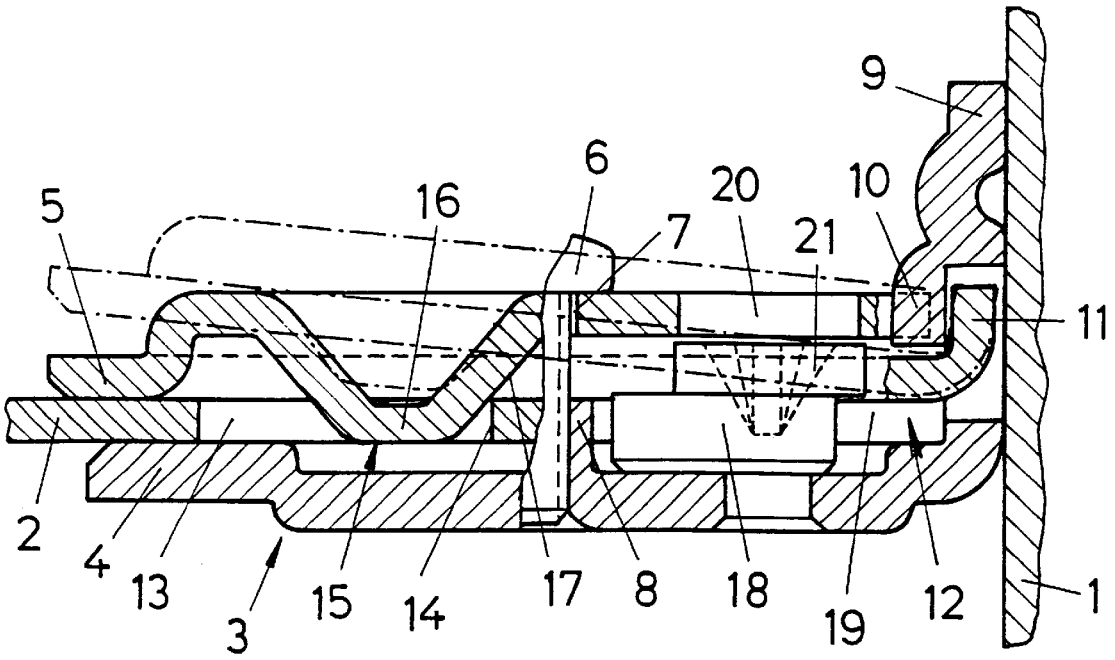
FIG. 2 shows a section along line II—II of FIG. 1 on a larger scale.

In accordance with the embodiment of an inventive device for fixing the front panel 1 at a metallic frame 2 of a drawer, which is represented in FIGS. 1 and 2, a holder 3 protruding towards the frame 2 is fixed at the front panel 1. The holder consists of a supporting plate 4 and a pressing plate 5 disposed opposite this supporting plate 4, between which plates 4, 5 the frame 2 is clamped by means of a clamping screw 6 which extends through the clamping plate 5 in a through hole 7 and is screwed into a threaded piece 8 of the supporting 4. The supporting plate 4 is a bent portion of a mounting flange 9 by which the supporting plate is affixed to the front panel 1. The mounting flange extends over a front end of the frame 2 and, on the side of the frame 2 opposite the supporting plate 4, has punched out lugs 10 bent out like hooks for hanging in the clamping plate 5. For this purpose is provided with engagement hooks 11 protruding beyond the edge of the plate, as can be seen best in from FIG. 2.

The front end of frame 2 has an insertion slot 12 for the clamping screw 6 screwed into the threaded piece 8. This insertion slot 12 extending in longitudinal direction of the frame has a widened portion 13 and transverse to the longitudinal direction of the frame 2. The front edge of this widened portion 13 provides a locking stop 14 for a locating stop 15 provided on the clamping plate 5, which locating stop consists of a wedge portion 16 formed on the clamping 5 and protruding towards the supporting plate 4. Since one of the two wedge faces of the wedge portion 16 constitutes a stop face 17 for the locking stop 14 of the frame 2, the mounting flange 9 is pulled by the stop face 17 of the locating stop 15 supported on the locking stop 14 against the end face of the frame 2, after mounting the holder 3 on the frame 2 by introducing the clamping screw 6 and the threaded piece 8 into the insertion slot 12 and subsequently tightening the clamping screw 6, because the engagement hooks 11 hung into the lugs 10 between the mounting flange 9 and the clamping plate 5 produce a positive pulling connection. When clamping the frame 2 between the supporting plate 4 and the clamping plate 5 a stable, clearance-free and positive connection between the holder 3 and the frame 2 is assured.

To avoid making the mounting of the holder 3 on the frame 2 or removing the holder 3 from the frame 2 more difficult by the locating stop 15 protruding against the supporting plate 4, the clamping plate 5 may be hung into the mounting flange 9 under a bias, so that the clamping plate 5 sticks out under an acute angle, as this is indicated in dash-dotted lines in FIG. 2. When tightening the clamping screw 6, it is due to this measure that the clamping plate 5 is first of all swivelled about the hook-like lugs 10 against the frame 2, until the wedge portion 16 correspondingly engages behind the locking stop 14. The resultant bias of the clamping plate 5 causes upon loosening the clamping screw 6, the clamping plate 5 to swivel back into the dash-dotted starting position, so that the locking stop 14 of the frame is released by the locating stop 15.

The vertical position of the holder 3 with respect to the frame 2 is determined by an adjusting eccentric 18, which is mounted in the supporting plate 4 and, when mounting the holder 3 on the frame 2, engages in the insertion slot 12, so that the insertion slot 12 forms a supporting stop for the adjusting eccentric 18 with its lower edge 19. When, accordingly, the adjusting eccentric 18 is adjusted by means of a screw driver engaging an adjusting head 21 accessible through a through hole 20 in the clamping plate 5, the front panel 1 can vertically be adjusted with respect to the frame 2, which is of course only possible when loosened clamping screw 6. For fixing the adjusted vertical position of the front panel 1, the clamping screw 6 must then again be tightened.

What is claimed is:

1. In a drawer, the combination of a lateral metallic frame, a front panel and a device for fixing the front panel on the lateral metallic frame, the combination comprising (a) a holder arranged at the front panel and protruding in a longitudinal direction towards the frame, the holder consisting of
  (1) a supporting plate,
  (2) a clamping plate, and
  (3) the frame being held between the supporting plate and the clamp plate, and having an insertion slot extending in the longitudinal direction and being open at an end facing the front panel, (b) a clamping screw extending through the frame in the insertion slot for clamping the frame between the supporting plate and the clamping plate, (c) an adjusting eccentric vertically supported in the insertion slot on a supporting stop of the frame, and (d) a locating stop having an inclined stop face,
  (1) the insertion slot having a widened portion extending transversely to the longitudinal direction and the widened portion having a forward edge extending transversely to the longitudinal direction forwardly of the locating stop in the direction of the front panel, the forward edge being engaged by the locating stop to constitute a locking stop.

2. The combination of claim 1, wherein the supporting plate is a bent portion of a mounting flange affixing the front panel to the frame, and the clamping plate forms the locating stop and is hooked into the mounting flange.

3. The combination of claim 2, wherein the clamping plate hooked into the mounting flange may be swiveled relative to the supporting plate.

4. The combination of claim 2, wherein the clamping screw has an engaging stop for the clamping plate on a side of the clamping plate facing away from the clamping screw head.

5. The combination of claim 1, wherein the locating stop consists of a wedge portion formed on the clamping plate and protruding towards the supporting plate.

6. The combination claim 1, wherein the supporting plate has a threaded hole receiving the clamping screw, and the adjusting eccentric is mounted on the supporting plate and is actuatable through a through hole in the clamping plate.

* * * * *